United States Patent [19]

Harris

[11] Patent Number: 4,531,732

[45] Date of Patent: Jul. 30, 1985

[54] POOL TABLE RAIL-MIRROR

[76] Inventor: David W. Harris, 397 Ray St., Pleasanton, Calif. 94566

[21] Appl. No.: 432,316

[22] Filed: Feb. 4, 1983

[51] Int. Cl.[3] ..... A63D 15/00

[52] U.S. Cl. ..... 273/14; 273/8; 273/70

[58] Field of Search ..... 273/14, 8, 9; 350/288, 350/193, 298, 289, 307, 321, 291, 304

[56] References Cited

U.S. PATENT DOCUMENTS

| | | | |
|---|---|---|---|
| 1,297,815 | 3/1919 | Englehart | 273/3 |
| 1,376,377 | 4/1921 | Mee | 350/304 |
| 1,862,094 | 6/1932 | Oishei | 350/288 |
| 3,462,593 | 8/1969 | Horan | 273/14 |
| 3,879,112 | 4/1975 | Hickey | 350/288 |
| 4,027,883 | 6/1977 | Batori | 273/14 |
| 4,246,811 | 1/1981 | Bondhus et al. | 81/436 |

*Primary Examiner*—Richard C. Pinkham
*Assistant Examiner*—T. Brown
*Attorney, Agent, or Firm*—Francis H. Lewis

[57] ABSTRACT

A pool table rail-mirror includes a long reflecting mirror which fits into the indentation under the rail cushion of a pool table. The mirror is supported near the upper edge of a hinge along a horizontal axis, so that the mirror can rotate through various angles relative to the vertical plane. The hinge is supported by an angle iron support fitting under the rail cushion. A machine screw passes through a hole in the lower portion of the movable hinge side, and engages a threaded fitting attached to the angle iron support. The hinge is held against the collar of the machine screw by a helical spring concentric with the screw. The head of the screw is provided with a hexagonal socket recession. A small fitting is further provided to fit over the end of a cue stick, having a hexagonal ball-head projecting from the end. This ball-head engages the hexagonal socket of the machine screw. The cue stick may thereby be used to adjust the machine screw and the orientation of the mirror relative to the vertical plane. This adjustment may be made with the cue stick held at any angle within a certain angular range relative to the axis of the machine screw. A player may use this cue stick to adjust the mirror so that any bank shot may be lined up by viewing the reflections of the target ball and target pocket in the mirror while the player is standing in his normal stance for making the shot. The device is removable and may be used by any player on any table.

4 Claims, 6 Drawing Figures

POOL TABLE RAIL-MIRROR

BACKGROUND OF THE INVENTION

1. Field of the Invention

This invention pertains generally to the field of games and amusement devices, and more particularly to the field of accessories for pool tables.

2. Description of the Prior Art

The table games of pool, billiards, and similar games are played by "shooting" the cue ball with the cue stick and causing it to collide with another ball so as to drive the target ball to a certain location, such as the pocket at the edge of the table. In some shots an alternative objective is to cause the cue ball, after suffering its first collision, to be deflected toward a second target ball. In both types of shots, players often accomplish these objectives by causing either the cue ball or the target ball to rebound from a rail cushion in a certain direction. Such shots are known as bank shots. In these shots, the player attempts to adjust the angle of incidence of the ball on the cushion so that the angle of rebound will be in the desired direction. If the ball collides elastically with the rail cushion, these angles will be equal. The player will therefore select the location on the rail such that the angle of rebound will be in the direction of the desired target, such as the table pocket. In order to achieve skill at the game, a player must develop the ability to accurately judge these angles.

Certain devices have been constructed in the past to aid in the development of this skill. One such device is disclosed in U.S. Pat. No. 3,463,593 (Horan) which describes a cue ball angle computer having a curved mirror to indicate the proper impact point for making accurate bank shots. This device is sometimes helpful in making bank shots in which the cue ball rebounds from the rail cushion. The device is used by moving it along the selected rail cushion and viewing the reflections of the cue ball and the target ball in the curved mirror. The position of this device is adjusted until these reflections appear at certain locations in the mirror, and the device indicates the necessary impact point on the rail cushion. Having located this impact point, the device is removed and the player shoots the cue ball toward this impact point.

The Horan device suffers from a serious drawback, in that the player must walk around the table and determine the point of impact, and then return back to the shooting position and make the shot. After having determined the impact point he must remember its precise location while returning to the shooting position, since the impact point is unmarked. This will generally introduce sufficient error in bank shots to cause the player to miss the shot, thus obviating the usefulness of the device. When a bank shot is made with the target ball striking the rail cushion, this error becomes much more important because it is the target ball which must be directed toward the impact point, rather than the cue ball. For this reason, the Horan device is substantially less useful in making target ball bank shots. Further, this device is rather complex and time-consuming to use, and it is of limited value in developing skill in making bank shots without the aid of the device. The player uses the device to measure the proper impact point, and then removes the device from the table and walks around to the shooting position. Thus, the device does not train the player to judge the impact point viewed from the shooting position.

To overcome these drawbacks, what is needed is a device that allows the player to "see" the shot directly at the time when he is preparing to shoot and to continue to "see" it during the entire shooting process. This would allow the player to view from the shooting position the entire geometry of the shot both before and after the collisions. A device which approaches these criteria is disclosed in U.S. Pat. No. 1,297,815 (Englehart), which teaches a pool table with mirrors or reflectors located under the rail cushion between the pockets to aid in making these bank shots. This device utilizes the optical principal of equality of the angles of incidence and reflection of rays of light. In making a bank shot, the player can view the target pocket and the target ball through the mirror, and judge the angle of the shot by lining up these reflections. The pocket and balls can be kept in view throughout the execution of the shot, so that the player does not have to remember the location of the impact point on the rail cushion. The device provides advantages over the invention of Horan in assisting a player to develop skill in judging these shots. However, this device suffers from the disadvantage that the mirrors are fixed in their angular position relative to the table and, being narrow mirrors, give the player a view of the pocket and target ball from a very narrow angular range of vision. This creates a problem in that different pool shots are necessarily made with different body positions or stances, and with varying angles at which the cue stick is held, and therefore the eyes of the player are at different heights above the table during the shot. Furthermore pool players vary in height and assume various postures while shooting, so that the player eye level above the table will vary considerably. Thus with the Englehart device only a very narrow range of bank shots can be seen by a given player. The balls will seldom be in such a position to afford the necessary view at the time of striking the cue ball without forcing the player to assume an unnatural sighting position to use this device. In short, for most bank shots a player will find this device difficult to use to line up the cue ball with the target ball and target pocket reflections in the mirror.

Accordingly, it is desirable to provide rail cushion mirrors which are movable, and which are adjustable in their orientation, so that they may be used with any bank shot regardless of the location of the cue ball, target ball, and target pocket, and regardless of the height or posture of the player and the height of the player's eyes above the table. Further, it is desirable to provide rail cushion mirrors for which these adjustments can be made by the player without moving from the location in which the shot is to be made. In addition, it is desirable to provide a rail cushion mirror which can be used and adapted on any pool table or billiard table, and which is portable and inexpensive to manufacture. It is further desirable to provide a rail cushion mirror which is decorative, and which has educational value in that it assists a player to learn to make accurate bank shots.

SUMMARY OF THE INVENTION

The improved pool table rail mirror disclosed herein provides a movable and adjustable mirror which will fit under the rail cushion of any standard pool table. The mirror is a long rectangular strip which is supported by a back plate and hinge, such that the angle of the mirror relative to the vertical plane may be adjusted to any desired position. The adjustment is made by rotating a small machine screw in the back plate directly below the mirror. The head of the machine screw is provided with a hexagonal socket, such that it may be rotated with a ball-head type Allen wrench. The invention also provides a small fitting which may be fastened to the end of a cue stick, having a short hexagonal ball-head projection extending along the axis of the stick. The ball-head end of this fitting is adapted to engage the hexagonal socket of the machine screw when the cue stick is held at an angle oblique to the axis of this screw, so that the screw may be rotated by turning the cue stick. With this specially fitted cue stick, the player may reach across the table and adjust the position of the mirror without moving from the location in which he intends to make the shot. He can thereby adjust the mirror while standing in this position until he is able to view the reflected images necessary to line up the bank shot. Since the specially fitted "cue stick wrench" can engage and rotate the machine screw from any direction within the angular cone allowed by the ball-head and hex socket, this adjustment may be made quickly and naturally by the player in his normal shooting stance. The entire mirror, back plate, hinge, and adjustment mechanism are mounted on a movable support, and the device may be used on any standard pool table or billiard table. The device is not attached to the table itself, so that the player has the option of playing with or without the device.

It is an object of this invention to provide a pool table rail-mirror which may be easily adjusted by a player without moving from the shooting position, and which can be used to line up any bank shot, independently of the positions of the balls and the pockets.

A second object of this invention is to provide a pool table rail-mirror which is portable and not attached to the table, and may be used on any standard pool table or billiard table.

A further object of this invention is to provide a pool table rail-mirror which is inexpensive, easily constructed, easy to use, and decorative.

Yet another object of this invention is to provide a pool table rail-mirror which will assist a player in developing skill in judging accurately the shooting angles for bank shots, and which may be so used for all types of such shots.

These and other objects, advantages, characteristics and features of this invention may be better understood by examining the following drawings together with the detailed description of the preferred embodiment.

DETAILED DESCRIPTION OF THE PREFERRED EMBODIMENT

Figure 1:
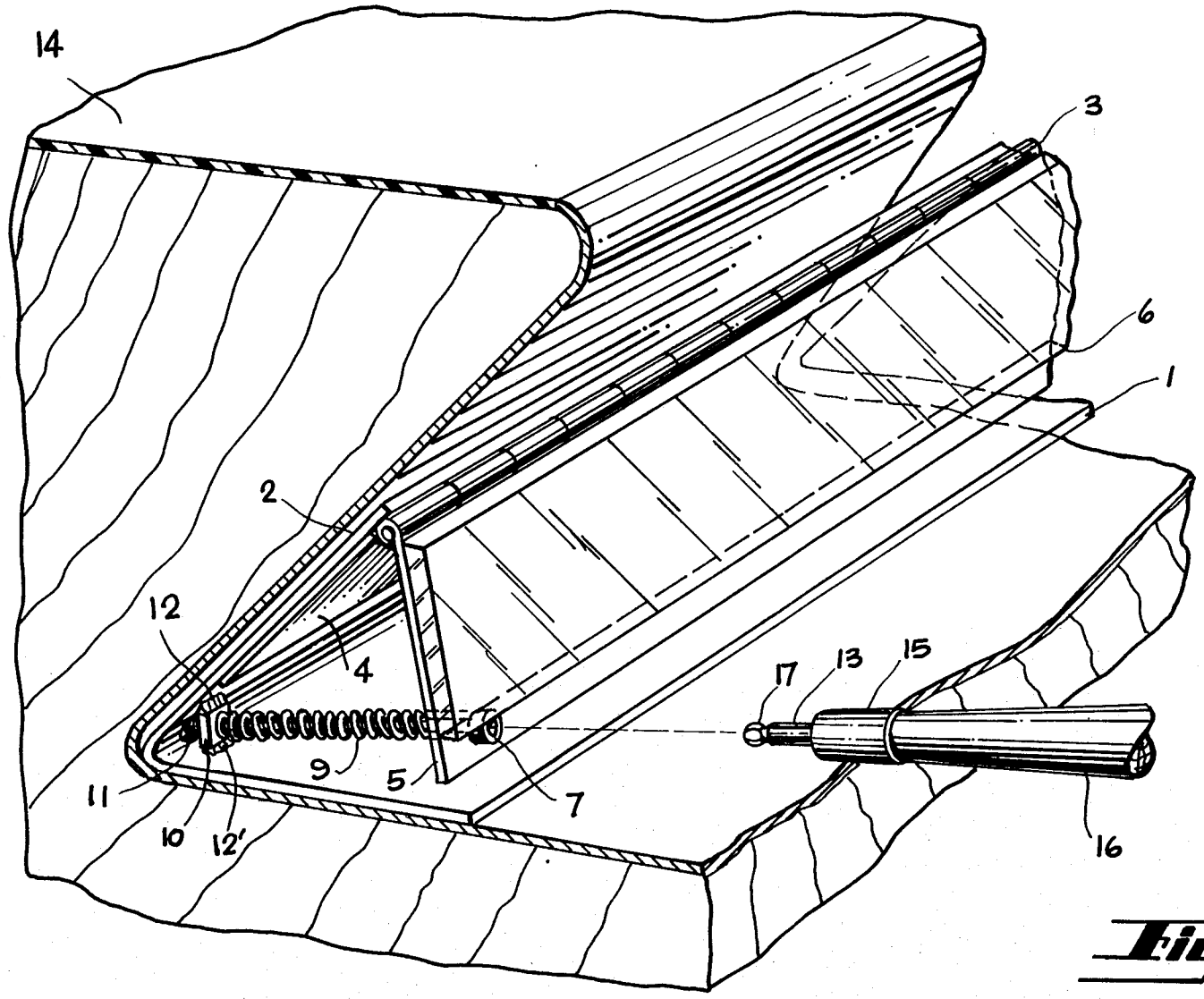
FIG. 1 is a perspective view of the end portion of the rail-mirror according to the present invention, positioned under the pool table rail cushion, illustrating the adjustment mechanism, and further showing the special ball-head fitting on the end of the adjustment cue stick.
Figure 2:
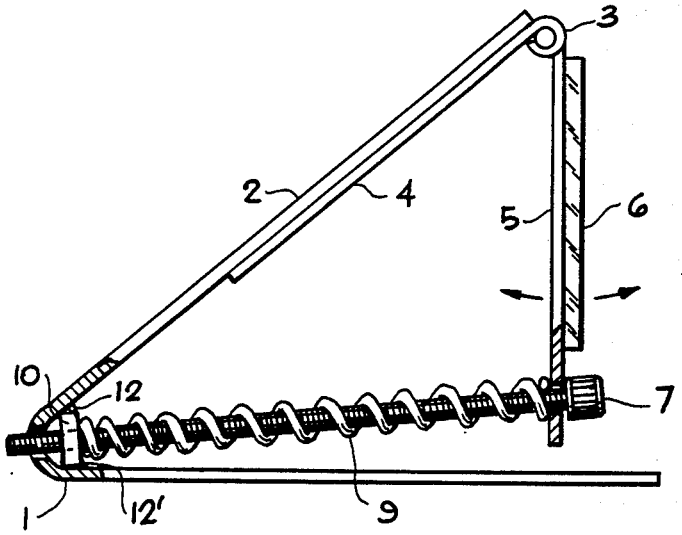
FIG. 2 is an end view of the rail-mirror device in FIG. 1.
Figure 3:
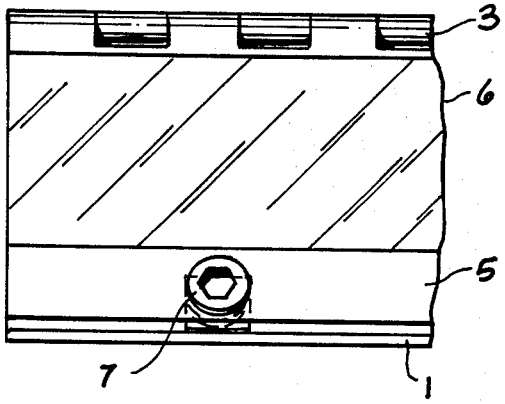
FIG. 3 is a front view of a section of the rail-mirror device of FIG. 1, as seen by a player during use.

Referring to the drawings, particularly FIGS. 1 through 4, the rail-mirror includes a long angle iron support having a flat horizontal base 1 which rests on the surface of the table, and a support back 2 which extends upward from the base at an acute angle such that the entire support fits into the indentation under the rail cushion 14 of a pool table. A long hinge 3, such as a piano hinge, is fastened on one side to the underside of the support back 2, such that the axis of the hinge extends horizontally along the upper edge of said support back. The other side of the hinge 5 is capable of rotation about this hinge axis, and may be tilted at various angles relative to the vertical plane through this axis. The movable side of the hinge 5 extends downward from the hinge axis, and is sufficiently short so that it barely clears the support base 1 as it rotates through the vertical direction. A long mirror 6 is attached to the movable side 5 of the hinge and extends along the entire length of the hinge adjacent to the hinge axis. The mirror faces outward from the angle formed by the support angle iron. The mirror is sufficiently narrow to leave a small strip of the movable hinge side 5 along the lower edge uncovered by the mirror. A machine screw 7 extends through a hole 8 located in this uncovered portion of the movable hinge side 5. The head of the screw faces outward from the angle formed by the support, and has a hexagonal socket opening engageable by an Allen wrench or hexagonal ball-head. The threaded end of the machine screw extends toward the apex of the angle iron. A threaded fitting, preferably a square nut 10, is fastened to the angle iron support inside the angle near the apex. The nut may be typically held in place by means of spot welds 12, 12' between the edges of the nut and the inner surfaces of the angle iron. The nut is aligned with the hole 8, so that the machine screw 7 threads into the nut 10. An aperture 11 is located at the apex through the angle iron, such that the threaded end of the machine screw may extend through the angle iron support when the screw is threaded down on the nut. A helical spring 9, concentric with the machine screw 7, extends from the nut 10 to the inner surface of the movable hinge side 5, and thereby urges the movable hinge side 5 against the collar of the machine screw 7. The diameter of the hole 8 is larger than that of the threaded portion of the machine screw 7, but less than the diameter of the machine screw head. The space between the edge of the hole and the shank of the screw is sufficiently large to allow the movable hinge side to rotate through a range of angles about the horizontal axis, even though the screw extends through the hole along a fixed screw axis. Accordingly, the movable hinge side is held in place against the head of the machine screw, which thereby determines the angle at which the mirror is tilted relative to the vertical plane. When the machine screw 7 is rotated, this angle may be increased or decreased depending on the direction of rotation of the screw.

Figure 6:
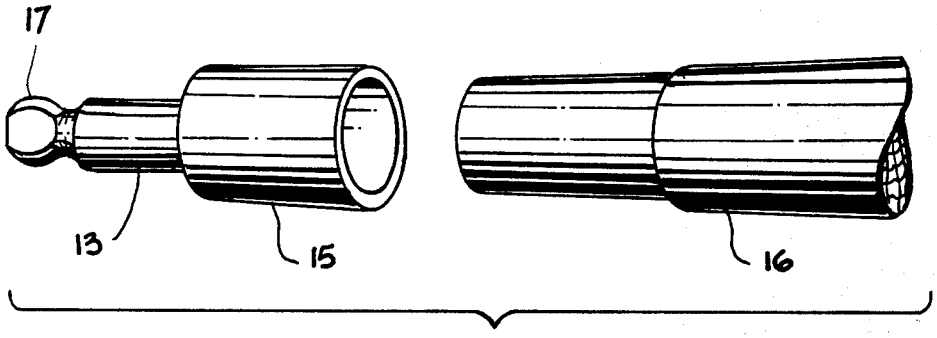
FIG. 6 is an exploded view of the adjustment cue stick section of FIG. 1, showing the special adjustment ball-head fitting for the end of the cue stick.
Figure 4:
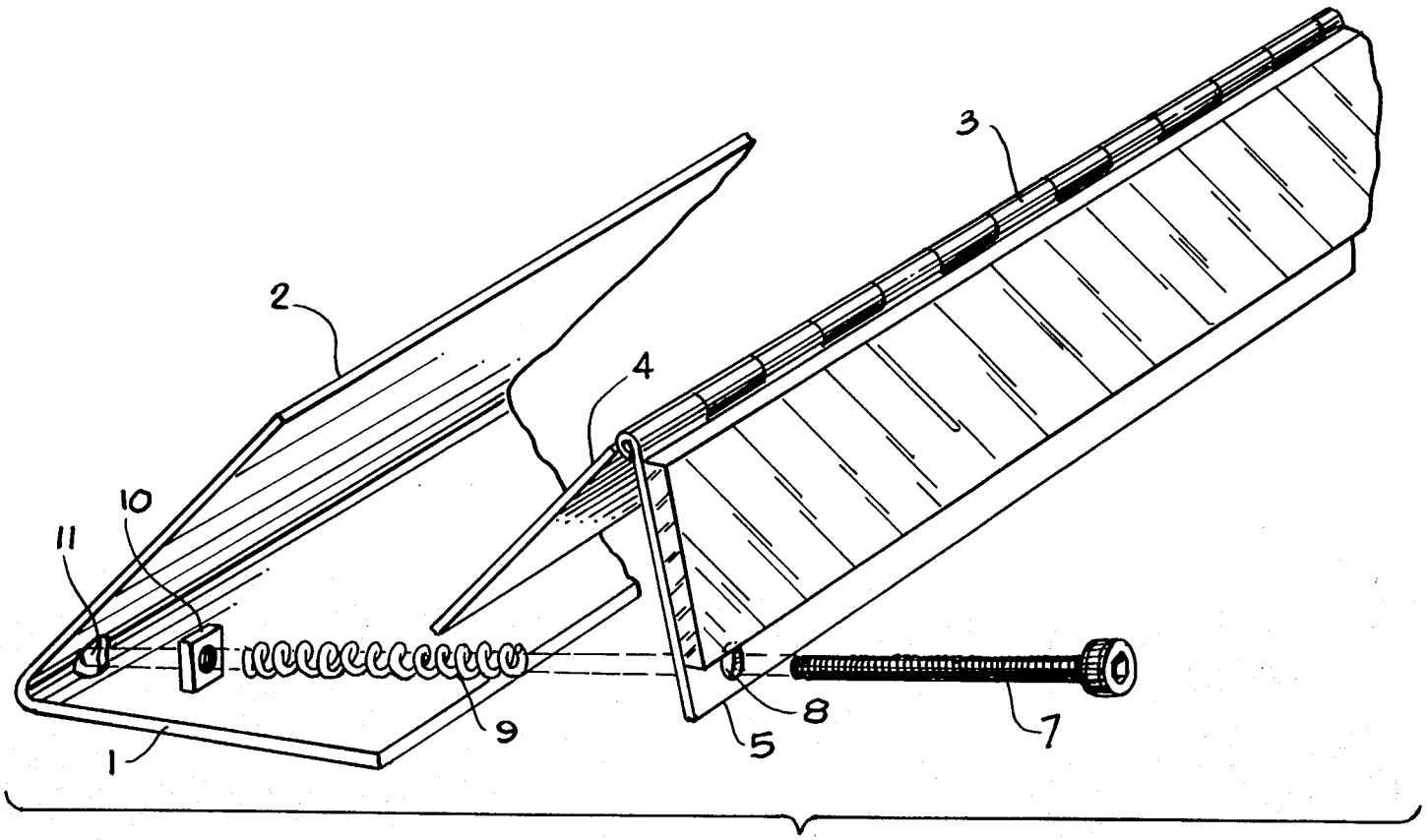
FIG. 4 is an exploded view of the section of the rail-mirror device of FIG. 1, showing the orientation and relationship of the various parts of the device.

Referring now to FIG. 6, a fitting is shown which is adaptable to the end of a cue stick 16. This fitting comprises a small hollow ferrule 15, which fits over the end of the cue. Extending outward from the end of the ferrule along the axis of the stick is a short rod-like section 13 having an Allen wrench-type ball-head 17 at its end. The ball-head is adapted to engage the hexagonal socket head of the machine screw 7 from any direction within a range of angles relative to the axis of the screw. This angular range depends on the details of construction of the ball-head and hex socket head. For conventional commercially available ball-head fittings and hex socket screws, this angular range is typically from 0 to 30 degrees relative to the screw axis. The specially fitted cue stick may therefore be used to adjust the machine screw and the orientation of the mirror about the hinge axis by inserting the ball-head fitting into the machine screw socket from any angle within this angular range and rotating the cue stick until the mirror is oriented at the proper angle to allow the player to see the reflections of the target ball and pocket. This adjustment may be made by the player while standing in his normal shooting posture on the opposite side of the table from the mirror, and viewing the image of the target ball and pocket in the mirror while making the adjustment.

Figure 5:
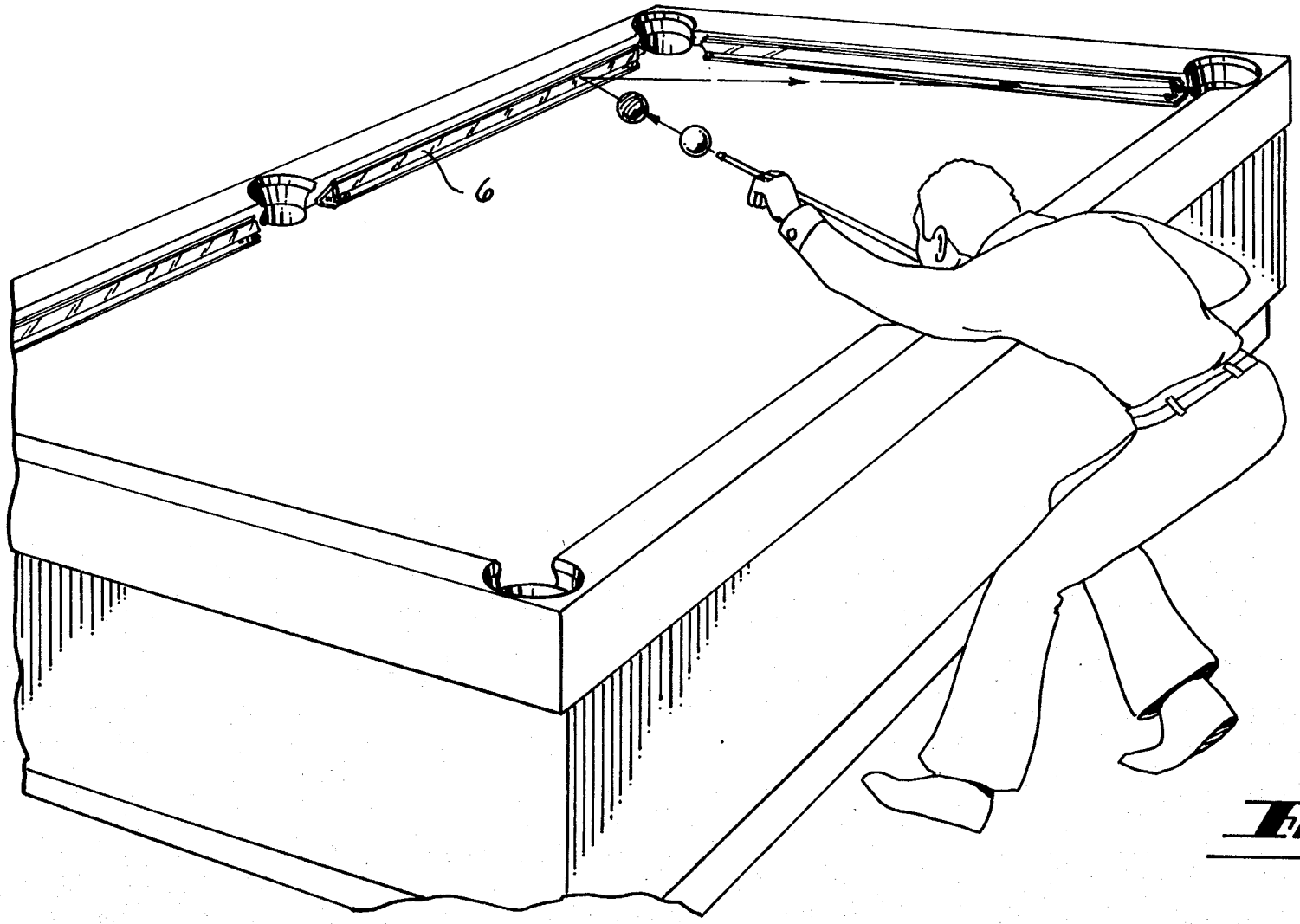
FIG. 5 is a perspective view of a pool table and a player utilizing the rail-mirror device to line up a bank shot.

Having adjusted the mirror to a suitable orientation, a player may line up a bank shot by viewing the images of the target ball and target pocket in the mirror, as illustrated in FIG. 5. In the illustrated configuration, the player shoots the cue ball in a direction to drive the target ball toward the reflected image of the target pocket. The player may further readjust the mirror by reaching across the table with the adjustment cue stick without moving from the shooting position. In this way, the player may practice various bank shots using this device and obtain experience in judging the impact point on the rail cushion while viewing it from his normal shooting posture. He may repeat the shot several times with the device in place, and then remove the device to test his ability to select the impact point. Thus, the device is a self-teaching tool which enables a player to gain skill in making various types of complex bank shots, as well as an aid to the player during actual games.

From the foregoing description, it will be seen that the apparatus disclosed herein is simple and inexpensive to construct, and easy to use. Its low cost makes it readily available to a large number of pool and billiard players, and it may be carried easily by the player. The device also provides decorative features when placed in position for use, by enhancing the attractiveness of the visual appearance of the table. This ornamental feature is further improved by placing a plurality of these devices under the rail cushions around the entire perimeter of the table.

It will be further appreciated that various modifications and changes may be made in the above described pool table rail-mirror while preserving the features and advantages set forth, that the foregoing description and drawings are illustrative and not limiting, and that the spirit and scope of the present invention are to be determined by reference to the appended claims.

What is claimed is:

1. A pool table rail-mirror comprising:

a rail-mirror adapted to fit under and extending along the rail cushion of a pool table;

adjustment means connected to said mirror, such that said mirror may be rotated about a horizontal axis;

support means connected to said mirror and adjustment means; and a fitting placed on the end of a cue stick and adapted to engage said adjustment means, such that said adjustment means may be operated by said cue stick.

2. A pool table rail-mirror as recited in claim 1, wherein said adjustment means comprise:

screw means engageable by said fitting and adjacent to said mirror, such that said mirror may be rotated by operation of said screw means; and spring means connected to said mirror and support means, such that said mirror is held stationary by said spring means when said screw means are not operated.

3. A pool table rail-mirror as recited in claim 2, wherein said screw means comprise:

a machine screw engageable by said fitting and adjacent to said mirror, such that said mirror may be rotated by the travel of said machine screw; and a threaded fitting attached to said support means and engaging said machine screw, such that rotation of said screw causes the screw to travel through said fitting.

4. A pool table rail-mirror as recited in claim 3, wherein said machine screw is provided with a polygonal socket head, and wherein said fitting is provided with a ball-head projection, said projection having a cross section perpendicular to the cue stick axis which is polygonal and similar to said socket head shape, and further having a cross section in a plane passing through said cue stick axis which is curved along its lateral edges, such that said machine screw may be engaged and rotated by said ball-head projection with said cue stick oriented at an angle oblique to the machine screw axis.

* * * * *